US006281605B1

(12) United States Patent
Terasaki

(10) Patent No.: US 6,281,605 B1
(45) Date of Patent: Aug. 28, 2001

(54) METHOD AND APPARATUS FOR PASSIVE SWITCHING HUB

(75) Inventor: Kazuhisa Terasaki, Campbell, CA (US)

(73) Assignee: Shinji Kichise, San Jose, CA (US)

( * ) Notice: Subject to any disclaimer, the term of this patent is extended or adjusted under 35 U.S.C. 154(b) by 0 days.

(21) Appl. No.: 09/107,659

(22) Filed: Jun. 30, 1998

(51) Int. Cl.[7] ..... H01H 9/00
(52) U.S. Cl. ..... 307/113
(58) Field of Search ..... 340/825.03, 825.04; 307/112, 113, 131; 379/219, 220; 370/359, 149, 351, 357, 386

(56) References Cited

U.S. PATENT DOCUMENTS 5,832,305 * 11/1998 Briggs et al. ..... 370/357
5,933,449 * 8/1999 Meyer ..... 340/825.03

* cited by examiner

*Primary Examiner*—Jeffrey Gaffin
*Assistant Examiner*—Rios Roberto
(74) *Attorney, Agent, or Firm*—Peninsula Law Group; Daniel Hopen

(57) ABSTRACT

An apparatus for splitting differential signals and methods of operating the same result in a low cost passive multiport differential signal switcher. The multiport differential signal switcher for operating on a signal originating from a signal source comprises a first port having a first transmit port and a first receive port configured to receive a signal at the first transmit port coupled to a first switching element and a second switching element, a second port having a second transmit port and a second receive port configured to receive a signal at the second receive port coupled to the second switching element and a third switching element and a third port having a third transmit port and a third receive port configured to receive a signal at the third receive port coupled to the first switching element and a fourth switching element wherein the originating signal from the first transmit port turns-on the first switching element and the second switching element to pass the originating signal to the second receive port and the third receive port, respectively.

19 Claims, 4 Drawing Sheets

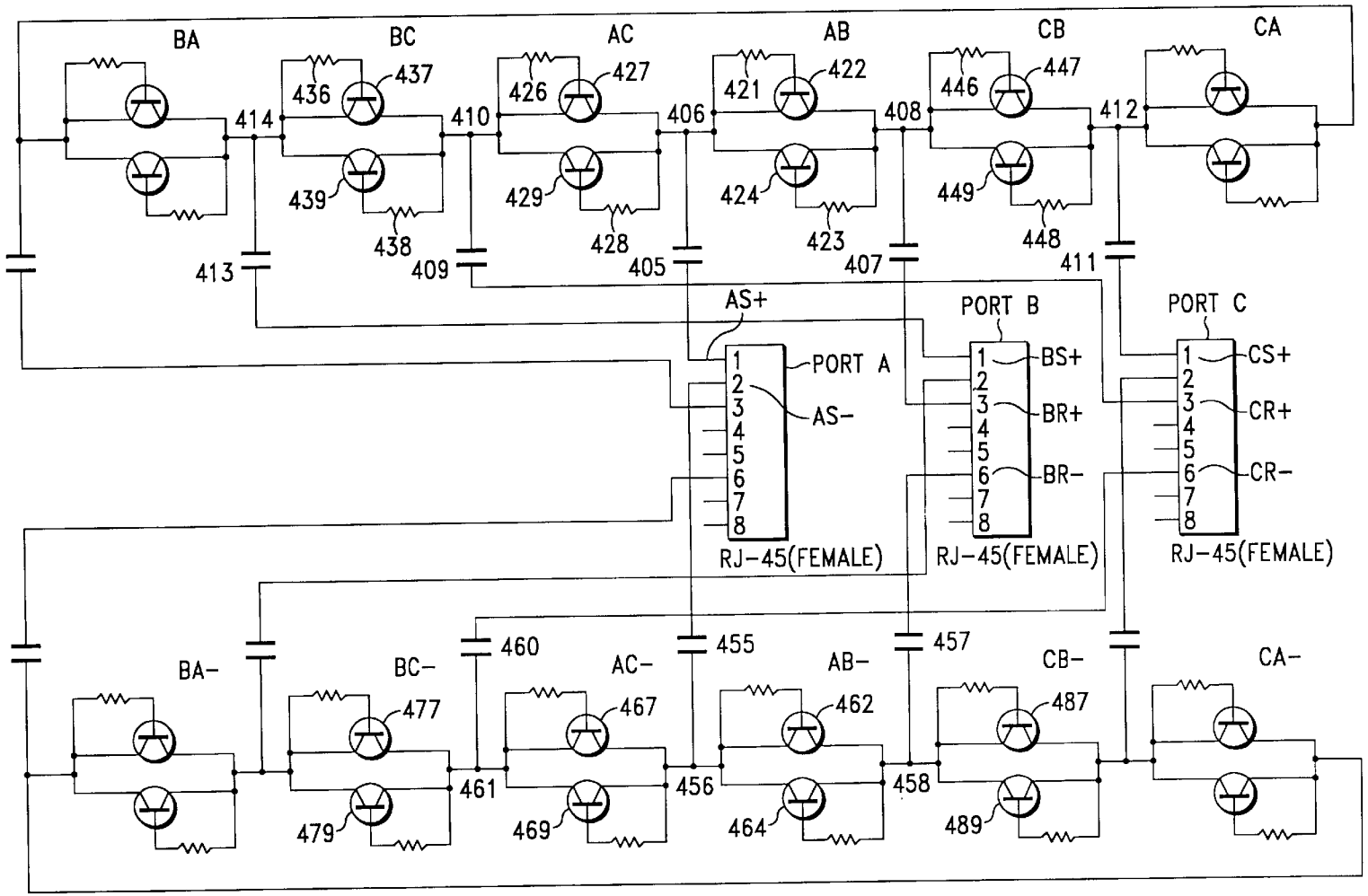
FIG.−4

METHOD AND APPARATUS FOR PASSIVE SWITCHING HUB

BACKGROUND OF THE INVENTION

1. Field of the Invention

The present invention relates to networking of electronic devices and more particularly to a passive switching hub for networking multiple devices to a transmission medium.

2. Description of the Related Arts

A local area network is a communication system that allows personal computers, workstations, servers, and other network devices within a small area, such as a single building or a group of adjacent buildings, to transfer information between each other. Each device connected to the network communicates with other device on the network by following a standard which defines the operation of the network. One of the most widely accepted standards for local area networks is the IEEE 802.3 CSMA/CD Ethernet Protocol.

In the CSMA/CD (Carrier Sense Multiple Access with Collision Detection) Ethernet Protocol, before transmitting data onto the network, each device first monitors the network to insure that no transmissions are currently in progress (Carrier Sense). When the network is idle (no transmissions in progress), each device can transmit information onto the network (Multiple Access). When more than one device transmits at the same time, each transmitting device must be able to detect this condition (Collision Detection), stop its transmission and retry.

The IEEE 802.3 CSMA/CD Ethernet protocol defines for physical layer specifications which differ primarily in the physical cables utilized. Coaxial cables are defined by a Thick Coax Ethernet (10BASE5), which utilizes a double-shielded coaxial cable, and a Thin Coax Ethernet (10BASE2), which utilizes a single-shielded coaxial cable. Twisted pair cables are 26 to 22 AWG unshielded wire. Two kinds of twisted pair exist. UTP is for unshielded, twisted pair, while STP is for shielded, twisted pair. UTP is what phone companies typically installed (though this is often not of high enough quality to support high-speed network use such as 10BaseT ethernet. UTP is graded according to its data carrying ability (e.g., Level 3, Level 4, Level 5). 10BaseT Ethernet requires at least Level 3 cable. Often what is now readily available is the Level 5 UTP having a RJ-45 connector.

Today, local area networks are becoming more and more prevalent and are often encountered to some degree by even casual computer users. Not only do personal computers, workstations, and servers utilize local area networks such as ethernet, but peripheral devices like printers, scanners, and digital cameras are also incorporating an ethernet interface. Ethernet being a relatively speedy and the widely accepted interface is becoming more popular in more devices. Thus, there is a growing need for providing readily available ethernet ports for new and existing devices, particularly for the causal computer users.

Even though multiple port hubs for ethernet having four ports, eight ports, 12 ports and even 24 ports are available, these hubs are often costly especially to cost conscience causal computer users. Moreover, even the smallest, a four port hub, takes up desk space and requires a separate power lead to an AC source. More often than not what is needed is an additional ethernet port than what is available.

For example, modern day network equipped computers have one network port and often that one network port is coupled to another network port fixed in of the wall for access to a local area network. Configured in this way leaves zero ports available for additional devices. The current available solutions for interfacing to another network equipped device are to 1) disconnect the current computer from the network and connect the other network device which may require crawling on hand and knees or 2) acquire a multiple port hub like the four port hub.

Even a stand alone user with only one network port on the back of the computer have needs for additional ports. If there is a printer connected to the network port and the user wants to connect a digital camera or scanner to the computer, the user will be unable without disconnecting and reconnecting already networked devices or purchasing at minimum a four port hub.

Therefore, it is desirable to provide a passive ethernet hub apparatus and methods of operating the same which provides a simpler less costly and cumbersome solution that better suits the network needs of its users.

SUMMARY OF THE INVENTION

The present invention provides an apparatus for a multiport differential signal switcher and methods for operating the same which splits a transmission signal to provide multiple transmission signals. The multiport differential signal switcher is based on a plurality of switches for splitting the transmission signal. Thus, according to one aspect of the invention, the multiport differential signal switcher for operating on a signal originating from a signal source comprises a first port having a first transmit port and a first receive port configured to receive a signal at the first transmit port coupled to a first switching element and a second switching element, a second port having a second transmit port and a second receive port configured to receive a signal at the second receive port coupled to the second switching element and a third switching element, and a third port having a third transmit port and a third receive port configured to receive a signal at the third receive port coupled to the first switching element and a fourth switching element wherein the originating signal from the first transmit port turns-on the first switching element and the second switching element to pass the originating signal to the second receive port and the third receive port, respectively.

According to another aspect of the invention, the first switching element, the second switching element, the third switching element, and the fourth switching element each include a current switch. The first switching element includes a first resistor and a first npn transistor, a first end of the first resistor coupled to the first transmit port and a collector of the first npn transistor, a second end of the resistor coupled to a base of the first npn transistor, and an emitter of the first npn transistor coupled to the third receive port and an output of the fourth switching element, and the second switching element includes a second resistor and a second npn transistor, a first end of the second resistor coupled to the first transmit port and a collector of the second npn transistor, a second end of the second resistor coupled to a base of the second npn transistor, and an emitter of the second npn transistor coupled to the second receive port and an output of the third switching element. The first npn transistor of the first switching element and the second npn transistor of the second switching element are in an on-state.

According to another aspect of the invention, the third switching element includes a third resistor and a third npn transistor, a first end of the first resistor coupled to the second receive port and a collector of the third npn transistor, a second end of the resistor coupled to a base of the third npn transistor, and an emitter of the third npn transistor coupled to a third transmit port and an input of a fifth switching element, and the fourth switching element includes a fourth resistor and a fourth npn transistor, a first end of the fourth resistor coupled to the third receive port and a collector of the fourth npn transistor, a second end of the fourth resistor coupled to a base of the fourth npn transistor, and an emitter of the fourth npn transistor coupled to a second transmit port and an input of a sixth switching element. The third npn transistor of the third switching element and the fourth npn transistor of the fourth switching element are in an off-state. The first switching element, the second switching element, the third switching element, and the fourth switching element each include an unidirectional current switch.

An apparatus and method of operating a multiport differential signal switcher are provided whereby no external power supply is needed to supply power to the multiple differential signal switcher to split a signal to produce two signals. Other aspects and advantages of the present invention can be seen upon review of the figures, the detailed description, and the claims which follow.

BRIEF DESCRIPTION OF THE DRAWING

FIG. 4 illustrates a detailed schematic of the passive ethernet hub in accordance to the present invention.

DETAILED DESCRIPTION OF THE INVENTION

Figure 1:
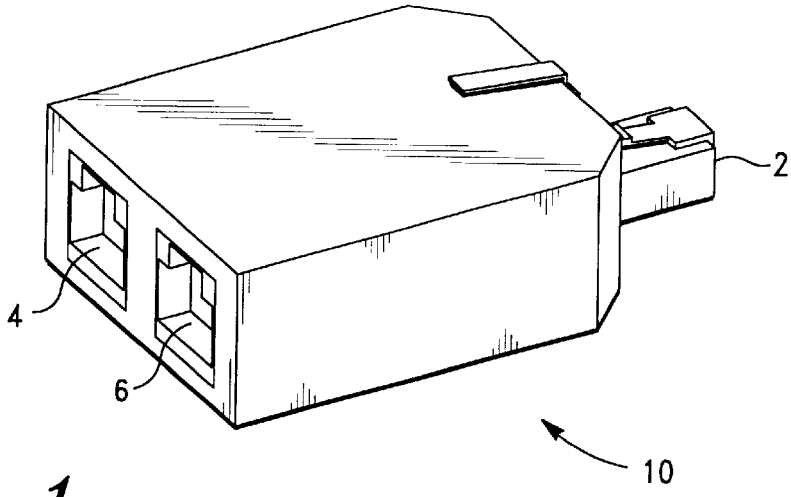
FIG. 1 illustrates an embodiment of a passive ethernet hub according to the present invention.
Figure 2:
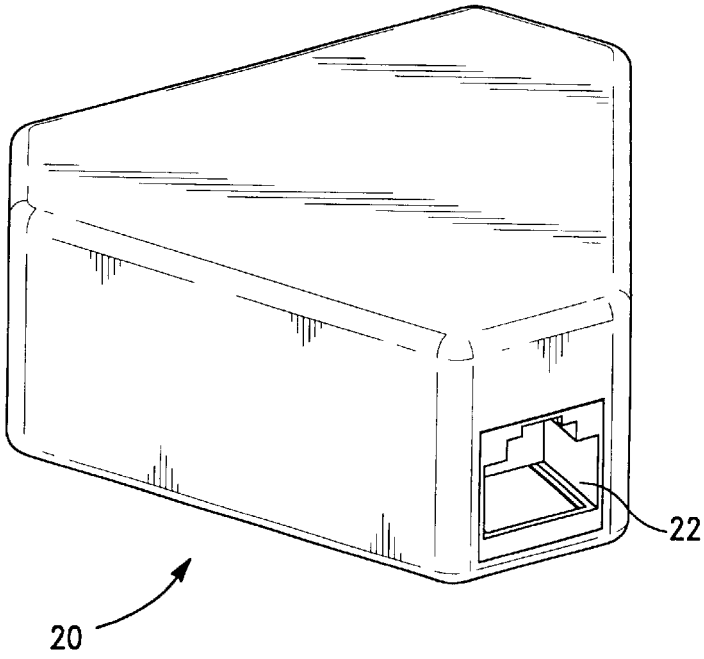
FIG. 2 illustrates an alternative embodiment of a passive ethernet hub according to the present invention.

The invention will be described with respect to the Figures in which FIG. 1 generally shows an embodiment of a passive ethernet hub 10 for splitting an ethernet signal. The passive ethernet hub 10 includes an I/O port 2, I/O port 4 and I/O port 6 that expands a single ethernet port to two ethernet ports. The I/O ports are designated as port A, port B and port C. The port designations will be used throughout this disclosure for the passive ethernet hub. The I/O port 2 mates to a standard RJ-45 receptacle commonly used for ethernet CSMA/CD based networks. These standard RJ-45 receptacles are often found on the back of network ready computers, network outlets in networked office environments, and ethernet hubs in a networked environment. The RJ-45 is serial connector which looks very much like a standard telephone connector, except it houses eight wires instead of four. I/O port 4 and I/O port 6 provide receptacles for receiving RJ-45 cabling. Gender changers and adapters are readily available to enable users of the passive ethernet hub 10 different connect configurations to suit their particular applications. Accordingly, FIG. 2 illustrates another embodiment of a passive ethernet hub 20. The passive ethernet hub 20 is aesthetically symmetric and configured with three RJ-45 receptacles of which receptacle 22 is shown in FIG. 2. Each receptacle electrically mates to RJ-45 cabling. Thus, a single ethernet port is expanded to include two ethernet ports. The passive ethernet hub 10 and the other embodiment of the passive ethernet hub 20 function like a phone outlet splitter or cable splitter that are commonly found in modern households but also provides standard hub functions well known for ethernet.

Figure 3A:
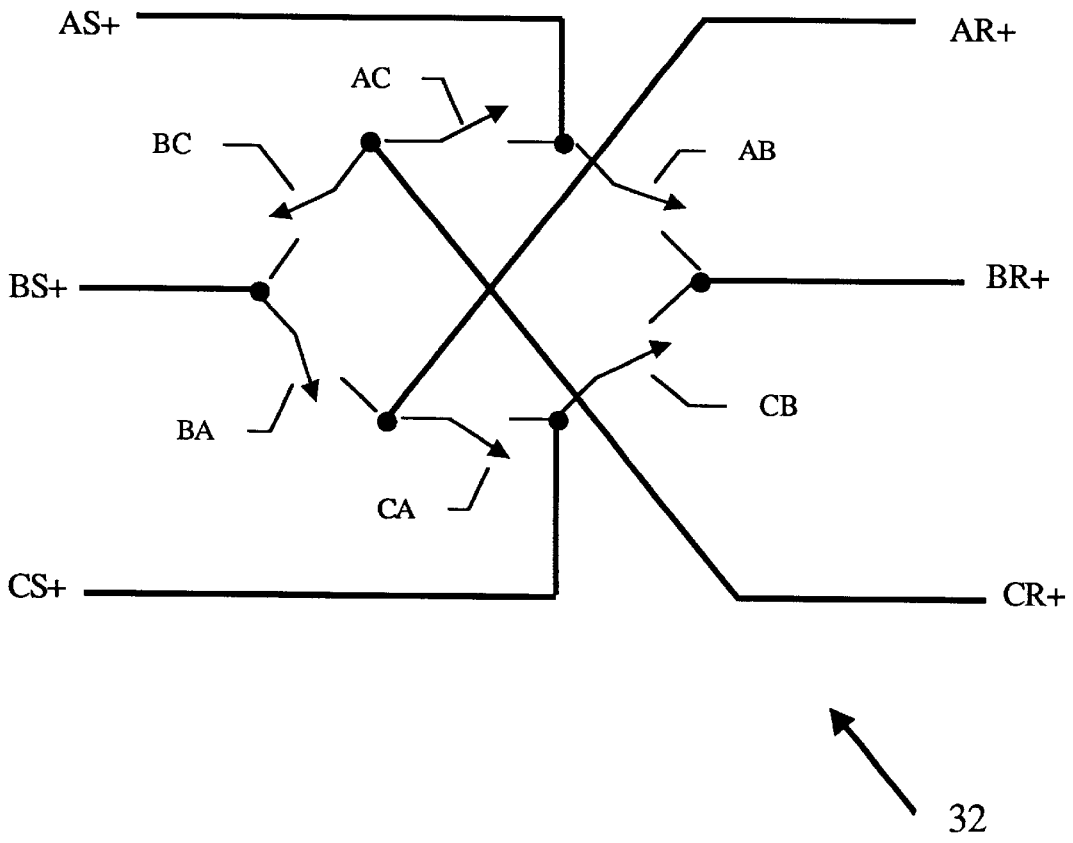
FIG. 3A and FIG. 3B illustrate simplified switching schematics of the passive Ethernet hub in accordance to the present invention.
Figure 3B:
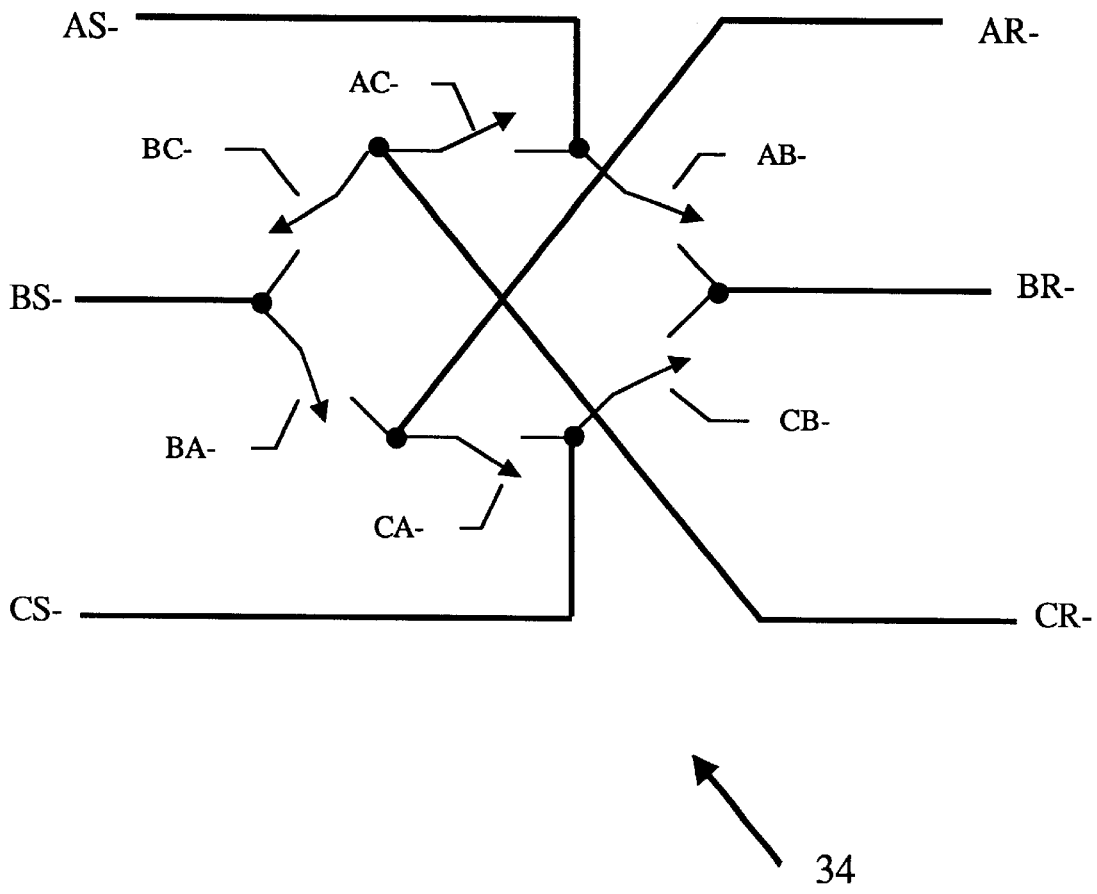

FIG. 3A and FIG. 3B illustrate simplified block diagrams of the passive ethernet hub 20. A hexagon schematic 32 and a hexagon schematic 34 depict a series of switches for coupling the various signals between the I/O ports of the passive ethernet hub 20. The hexagon schematic 32 of FIG. 3A shows positive signal switches for the passive ethernet hub 20. The hexagon schematic 34 of FIG. 3B shows negative signal switches for the passive ethernet hub 20. An ethernet signal is a differential signal that uses two wires, one of which carries the normal signal (V) and the other carries an inverted version signal (−V). A differential amplifier at the receiver (not shown) subtracts the inverted signal from the normal signal to yield a signal proportional to V. This subtraction is intended to cancel out any noise induced in the wires, on the assumption that the same level of noise will have been induced in both wires. Often times, twisted pair wiring is used to try to ensure that the noise is induced in both wires. The hexagon schematic 32 depicts the positive signal (V) and the hexagon schematic 34 depicts the inverted version of the positive signal (−V). Since the inverted version of the positive signal behave similarly as the positive signal, for clarity and brevity sakes, the positive signals for the passive ethernet hub are described in more detail.

The three ports of the passive ethernet hub designated as port A, port B, and port C each include S+, S−, R+, and R− representing a send positive signal, send negative signal, receive positive signal, and a receive negative signal, respectively. Thus, each of the three ports has four signals associated with the port. Port A has AS+, AS−, AR+, and AR−; port B has BS+, BS−, BR+, and BR−; and port C has CS+, CS−, CR+, and CR−.

The hexagon schematic 32 includes signal nodes for AS+, AR+, BS+, BR+, CS+, and CR+. Similarly, the hexagon schematic 34 includes signal nodes for AS−, AR−, BS−, BR−, CS−and CR−. Since ethernet signals are transmitted serially over a shared network channel that is attached to each ethernet equipped device, a device sending data to another device first listens to the shared network channel and determines the channel is free before transmission of the ethernet signals. A detailed discussion of an ethernet system is found in "Practical Networking with Ethernet" by Charles E. Spurgeon ISBN: 1-85032-885-4 and is hereby incorporated by reference.

Coupling the passive ethernet hub 20 to an ethernet network as published in the IEE 802.3 standard, the hub 20 receives an ethernet signal from a device coupled to port A AS+as shown in hexagon schematic 32, switch AB closes and switch AC closes to pass the ethernet signal to port B BR+ and port C CR+. The adjacent switches BA and CB remain open and isolate nodes BS+ and CS+ from the applied ethernet signal at port A AS+. Similarly, when a ethernet signal applied to port B BS+, switch BA closes and switch BC closes to provide a path for the ethernet signal to port A AR+ and port C CR+. The adjacent switches CA and AC remain open and isolate nodes AS+ and CS+ from the applied ethernet signal at port B BS+. Ethernet signals applied to port C CS+ are routed to AR+ and BR+ via switch CA and switch CB. The adjacent switches AB and BA remain open and isolate nodes AS+ and BS+ from the applied ethernet signal at port C CS+.

The inverted signals for the passive ethernet hub 20 are shown in the hexagon schematic 34. Ethernet signals received at port A line AS− activates switch AB− and switch AC− to provide a signal path for the ethernet signal to port B line BR– and port C CR–. Ethernet signals received at port B line BS– activates switch BA– and switch BC– to provide a signal path for the ethernet signal to port A line AR– and port C CR–. Similarly, ethernet signals received at port C line CS– activates switch CA– and switch CB– to provide a signal path for the ethernet signal to port A line AR– and port B BR–. Thus, the passive ethernet hub 20 divides a single ethernet signal applied to port A, for example, to provide the ethernet signal at both port B and port C.

FIG. 4 illustrates a schematic for an embodiment of the passive ethernet hub 20. Switches AB, AC, BA, BC, CA, and CB for the positive signal are shown. Switches AB–, AC–, BA–, BC–, CA–, and CB– for the inverse of the positive signal are also shown. Each switch comprises a combination of resistors and transistors that have been optimized to function as current switches. The resistors shown are 220 ohms; the transistors are npn transistors 2N3904A. Capacitors are 0.01 micro-farads. The capacitors isolates DC components of an ethernet signal that may be present. In most cases, the capacitors are not needed for the passive ethernet hub 20 to function but are included for compatibility to transceivers that exhibit a DC component. Those skilled in the art will appreciate that variations or substitutions to the specified components can be used to achieve the same desired result. For example pnp transistors or mosfets may be substituted for the npn transistors to provide the switching functions.

In the present embodiment, port A, port B, and port C are RJ-45 receptacles with eight (8) pins. The RJ-45 receptacles are also referred to as the female connector. Following the convention for ethernet using the RJ-45 pinout, pin 1 is TX+, pin 2 TX–, pin 3 RX+, and pin 6 RX–. Referring to FIG. 3, port A pin 1 corresponds with AS+, and port A pin 3 corresponds with AR+. Port B pin 1 corresponds with BS+, and port B pin 3 corresponds with BR+. Port C pin 1 corresponds with CS+, and port C pin 3 corresponds with CR+. Similarly, Port A pin 2 corresponds with AS–, and port A pin 6 corresponds with AR–. Port B pin 2 corresponds with BS–, and port B pin 6 corresponds with BR–. Port C pin 2 corresponds with CS–, and port C pin 6 corresponds with CR–. Capacitor 405 is coupled between AS+ and node 406. Switch AB includes resistors 421 and 423 and transistors 422 and 423. Resistor 421 is coupled between node 406 and base of transistor 422. Collector of transistor 422 is coupled to emitter of transistor 424. Resistor 423 is coupled between node 408 and base of transistor 424. Collector of transistor 424 is coupled to emitter of transistor 422 and node 408. Capacitor 407 is coupled between node 408 and port B pin 3, BR+. Switch AC include resistors 426 and 428 and transistors 427 and 429. Resistor 428 is coupled between node 406 and base of transistor 429. Collector of transistor 429 is coupled to emitter of transistor 427. Resistor 426 is coupled between node 410 and base of transistor 427. Collector of transistor 427 is coupled to emitter of transistor 429 and node 410. Capacitor 409 is coupled between node 410 and port C pin 3, CR+.

Switch CB includes resistors 446 and 448 and transistors 447 and 449. Resistor 446 is coupled between node 408 and base of transistor 447. Collector of transistor 447 is coupled to emitter of transistor 449. Resistor 448 is coupled between node 412 and base of transistor 449. Collector of transistor 449 is coupled to emitter of transistor 447 and node 412. Capacitor 411 is coupled between node 411 and port C pin 1, CS+. Switch BC includes resistors 436 and 438 and transistors 437 and 439. Resistor 438 is coupled between node 410 and base of transistor 439. Collector of transistor 439 is coupled to emitter of transistor 437. Resistor 436 is coupled between node 414 and base of transistor 437. Collector of transistor 437 is coupled to emitter of transistor 439 and node 414. Capacitor 413 is coupled between node 413 and port B pin 1, BS+.

In an operation example, as port A pin 1 receives an ethernet signal, switch AB and switch AC turns on to provide a path for the ethernet signal to port B pin 3 and port C pin 3. In particular, the ethernet signal applied to port A pin 1, AS+ activates transistor 422 of switch AB to provide a signal path to port B pin 3, BR+; the ethernet signal also activates transistor 429 of switch AC to provide a signal path to port C pin 3, CR+. However, transistor 447 and transistor 449 of switch CB and transistor 437 and transistor 439 of switch BC do not turn on.

An inverted ethernet signal also received at port A pin 2, AS– activates switch AB– and switch AC–. In particular, transistor 462 of switch AB– turns on and transistor 467 of switch AC– turns on. The inverted ethernet signal travels via capacitor 455, node 456, transistor 462 of switch AB–, and capacitor 457 to port B pin 6, BR– and via transistor 469 of switch AC–, and capacitor 460 to port C pin 6 CR–. Transistors 477 and 479 of switch BC– and transistors 487 and 488 of switch CB– remain in their off state and do not provide a signal path for the ethernet signal at node 461 and node 458. Thus, a single ethernet signal received at port A is split to provide the ethernet signal at both port B and port C.

Ethernet signals applied at port B similarly routes the ethernet signal to port A and port C. Signals applied to port C routes to port A and port B. No external power supply cord or power transformer is needed to operate the signal splitting function. Thus, the passive ethernet hub provides a novel cost effective compact solution for networking ethernet equipped devices.

While the foregoing detailed description has described present embodiments of the apparatus and methods for a passive ethernet hub in accordance with this invention, it is to be understood that the above description is illustrative only and not limiting of the disclosed invention. Obviously, many modifications and variations will be apparent to the practitioners skilled in this art. Accordingly, the apparatus and methods for a passive ethernet hub have been provided. The passive ethernet hub splits an ethernet signal to provide multiple ethernet signals.

What is claimed is:

1. A multiport differential signal switcher for operating on a signal originating from a signal source comprising:

a first port having a first transmit port and a first receive port configured to receive a signal at the first transmit port coupled to a first switching element and a second switching element;

a second port having a second transmit port and a second receive port configured to receive a signal at the second receive port coupled to the second switching element and a third switching element; and a third port having a third transmit port and a third receive port configured to receive a signal at the third receive port coupled to the first switching element and a fourth switching element wherein the originating signal from the first transmit port turns-on the first switching element and the second switching element to pass the originating signal to the second receive port and the third receive port, respectively.

2. The multiport differential signal switcher of claim 1, wherein the first switching element, the second switching element, the third switching element, and the fourth switching element each include a current switch.

3. The multiport differential signal switcher of claim 2, wherein:

the first switching element includes a first resistor and a first npn transistor, a first end of the first resistor coupled to the first transmit port and a collector of the first npn transistor, a second end of the resistor coupled to a base of the first npn transistor, and an emitter of the first npn transistor coupled to the third receive port and an output of the fourth switching element; and the second switching element includes a second resistor and a second npn transistor, a first end of the second resistor coupled to the first transmit port and a collector of the second npn transistor, a second end of the second resistor coupled to a base of the second npn transistor, and an emitter of the second npn transistor coupled to the second receive port and an output of the third switching element.

4. The multiport differential signal switcher of claim 3, wherein the first npn transistor of the first switching element and the second npn transistor of the second switching element are in an on-state.

5. The multiport differential signal switcher of claim 3, wherein:

the third switching element includes a third resistor and a third npn transistor, a first end of the first resistor coupled to the second receive port and a collector of the third npn transistor, a second end of the resistor coupled to a base of the third npn transistor, and an emitter of the third npn transistor coupled to a third transmit port and an input of a fifth switching element; and the fourth switching element includes a fourth resistor and a fourth npn transistor, a first end of the fourth resistor coupled to the third receive port and a collector of the fourth npn transistor, a second end of the fourth resistor coupled to a base of the fourth npn transistor, and an emitter of the fourth npn transistor coupled to a second transmit port and an input of a sixth switching element.

6. The multiport differential signal switcher of claim 5, wherein the third npn transistor of the third switching element and the fourth npn transistor of the fourth switching element are in an off-state.

7. The multiport differential signal switcher of claim 5, wherein the first switching element, the second switching element, the third switching element, and the fourth switching element each include an unidirectional current switch.

8. The multiport differential signal switcher of claim 7, wherein:

the first switching element includes a first prime resistor and a first prime npn transistor, a first end of the first prime resistor coupled to the third receive port, an output of the fourth switching element and a collector of the first prime npn transistor, a second end of the resistor coupled to a base of the first prime npn transistor, and an emitter of the first prime npn transistor coupled to the first transmit port and an input of the second switching element;

the second switching element includes a second prime resistor and a second prime npn transistor, a first end of the second resistor coupled to the second receive port, a collector of the second prime npn transistor, and an output of the third switching element, a second end of the second prime resistor coupled to a base of the second prime npn transistor, and an emitter of the second prime npn transistor coupled to the first transmit port and an input of the first switching element;

the third switching element includes a third prime resistor and a third prime npn transistor, a first end of the third prime resistor coupled to a third transmit port, an input of the fifth switching element and a collector of the third prime npn transistor, a second end of the resistor coupled to a base of the third prime npn transistor, and an emitter of the third prime npn transistor coupled to the second receive port and an output of the second switching element;

the fourth switching element includes a fourth prime resistor and a fourth prime npn transistor, a first end of the fourth prime resistor coupled to a second transmit port, an input to a sixth switching element, and a collector of the fourth prime npn transistor, a second end of the fourth prime resistor coupled to a base of the fourth npn transistor, and an emitter of the fourth npn transistor coupled to the third receive port and an output of the first switching element; and the sixth switching element includes a sixth resistor and a sixth npn transistor, a first end of the sixth resistor coupled to the second transmit port, an input of the fourth switching element and the collector of the sixth npn transistor, a second end of the sixth resistor coupled to a base of the sixth npn transistor, and an emitter of the sixth npn transistor coupled to the first receive port and an output of the fifth switching element wherein the originating signal from the second transmit port turns on the sixth switching element and the fourth switching element to pass the originating signal to the first receive port and the third receive port, respectively.

9. A multiport ethernet signal splitter having a plurality of switching elements wherein each switching element includes an input and an output and wherein each port of the multiport ethernet signal splitter includes a transmit port and a receive port, the multiport ethernet signal splitter comprising:

a first switching element having an input coupled to a first port transmit port and an output coupled to a third port receive port; and a second switching element having an input coupled to the first port transmit port and an output coupled to a second port receive port wherein an ethernet signal applied to the first port transmit port turns-on the first switching element and the second switching element to transfer the ethernet signal to the third port receive port and the second port receive port, respectively.

10. The multiport ethernet signal splitter of claim 9 further comprising:

a third switching element having an input coupled to a third port transmit port and an output coupled to a second port receive port;

a fourth switching element having an input coupled to the third port transmit port and an output coupled to a first port receive port wherein an ethernet signal applied to the third port transmit port turns-on the third switching element and the fourth switching element to transfer the ethernet signal to the second port receive port and the first port receive port, respectively.

11. The multiport ethernet signal splitter of claim 10 further comprising:

a fifth switching element having an input coupled to a second port transmit port and an output coupled to a third port receive port and the output of the first switching element;

a sixth switching element having an input coupled to the second port transmit port and an output coupled to the first port receive port and the output of the fourth switching element wherein an ethernet signal applied to the second port transmit port turns-on the fifth switching element and the sixth switching element to transfer the ethernet signal to the third port receive port and the first port receive port, respectively.

12. The multiport ethernet signal splitter of claim 11 further comprising:

a first negative switching element having an input coupled to a first negative port transmit port and an output coupled to a third negative port receive port; and a second negative switching element having an input coupled to the first negative port transmit port and an output coupled to a second negative port receive port wherein a negative ethernet signal applied to the first negative port transmit port turns-on the first negative switching element and the second negative switching element to transfer the negative ethernet signal to the third negative port receive port and the second negative port receive port, respectively.

13. The multiport ethernet signal splitter of claim 12 further comprising:

a third negative switching element having an input coupled to a third negative port transmit port and an output coupled to a second negative port receive port and the output of the second negative switching element;

a fourth negative switching element having an input coupled to the third negative port transmit port and an output coupled to a first negative port receive port wherein an ethernet signal applied to the third negative port transmit port turns-on the third negative switching element and the fourth negative switching element to transfer the ethernet signal to the second negative port receive port and the first negative port receive port, respectively.

14. The multiport ethernet signal splitter of claim 13 further comprising:

a fifth negative switching element having an input coupled to a second negative port transmit port and an output coupled to a third negative port receive port and the output of the first negative switching element;

a sixth negative switching element having an input coupled to the second negative port transmit port and an output coupled to the first negative port receive port and the output of the fourth negative switching element wherein an ethernet signal applied to the second negative port transmit port turns-on the fifth negative switching element and the sixth negative switching element to transfer the ethernet signal to the third negative port receive port and the first negative port receive port, respectively.

15. A method of operating a multiport ethernet hub for splitting an ethernet signal comprising the steps:

receiving the ethernet signal at a first port transmit port coupled to a first switching element and a second switching element;

activating the first switching element to transfer the ethernet signal to a second port receive port; and activating the second switching element to transfer the ethernet signal to a third port receive port.

16. The method of operating a multiport ethernet hub according to claim 15 further comprising the steps:

receiving the ethernet signal at a second port transmit port coupled to a third switching element and a fourth switching element;

activating the third switching element to transfer the ethernet signal to the third port receive port; and activating the fourth switching element to transfer the ethernet signal to a first port receive port.

17. The method of operating a multiport ethernet hub according to claim 16 further comprising the steps:

receiving the ethernet signal at a third port transmit port coupled to a fifth switching element and a sixth switching element;

activating the fifth switching element to transfer the ethernet signal to the second port receive port; and activating the sixth switching element to transfer the ethernet signal to the first port receive port.

18. The method of operating a multiport ethernet hub according to claim 17, wherein:

the first switching element, the second switching element, the third switching element, the fourth switching element, the fifth switching element, and the sixth switching element include an uni-directional switch.

19. The method of operating a multiport ethernet hub according to claim 17, wherein:

inputs of the first switching element and the second switching element are coupled;

inputs of the third switching element and the fourth switching element are coupled;

inputs of the fifth switching element and the sixth switching element are coupled;

outputs of the first switching element and the third switching element are coupled;

outputs of the second switching element and the fifth switching element are coupled; and outputs of the fourth switching element and the sixth switching element are coupled.

* * * * *